US006578219B1

(12) United States Patent
Gabel et al.

(10) Patent No.: US 6,578,219 B1
(45) Date of Patent: Jun. 17, 2003

(54) MATTRESS OVERLAY FOR OPERATING ROOM TABLE

(75) Inventors: Dustin Gabel, Denver, CO (US); Ronald B. Hicks, San Antonio, TX (US)

(73) Assignee: KCI Licensing, Inc., San Antonio, TX (US)

( * ) Notice: Subject to any disclaimer, the term of this patent is extended or adjusted under 35 U.S.C. 154(b) by 0 days.

(21) Appl. No.: 09/320,403

(22) Filed: May 26, 1999

(51) Int. Cl.[7] ..... A47C 27/10

(52) U.S. Cl. ..... 5/710; 5/737; 5/738; 5/600; 5/601; 5/911

(58) Field of Search ..... 5/710, 600, 737, 5/738, 654, 601, 911

(56) References Cited

U.S. PATENT DOCUMENTS

| | | | | | |
|---|---|---|---|---|---|
| 3,241,161 | A | * | 3/1966 | Dashosm | 5/490 |
| 4,728,551 | A | | 3/1988 | Jay | 428/76 |
| 5,050,256 | A | * | 9/1991 | Woodcock | 5/490 |
| 5,101,527 | A | * | 4/1992 | Wadsworth, III et al. | 5/737 |
| 5,421,874 | A | | 6/1995 | Pearce | 106/122 |
| 5,511,260 | A | | 4/1996 | Dinsmoor, III | |
| 5,549,743 | A | | 8/1996 | Pearce | 106/122 |
| 5,592,706 | A | | 1/1997 | Pearce | 5/654 |
| 5,626,657 | A | | 5/1997 | Pearce | 106/122 |
| 5,737,788 | A | | 4/1998 | Castellino et al. | 5/655.5 |
| 5,829,081 | A | | 11/1998 | Pearce | 5/654 |
| 5,910,081 | A | * | 6/1999 | Graham | 5/738 |
| 5,966,763 | A | * | 10/1999 | Thomas et al. | 5/600 |
| 6,006,383 | A | * | 12/1999 | Pile et al. | 5/706 |

OTHER PUBLICATIONS

Jay, Rick, Pressure and Shear: Their Effects on Support Surface Choice, *Ostomy/Wound Management*, Sep. 1995, pp. 36–38, 40–45.

Steris Corporation, Amsco Surgical Table Accessories Catalog, 1988, pp. 2, 3, 5–13.

* cited by examiner

*Primary Examiner*—Alex Grosz

(57) ABSTRACT

A patient supporting surface for use with a conventional operating room table having at least one pad for supporting a patient, wherein the pad has a chamber for containing a quantity of fluid. The chamber is a dual-layer, urethane envelope having an upper and lower portion. The fluid contained within the chamber is a deformable and pressure compensating, radiolucent fluid. The chamber and the fluid are cooperatively adapted to maintain the patient in a fixed position while substantially minimizing the interface pressure and shear force between the pad and the patient. A cover sheet may be removably attachable about the fluid-filled chambers and comprises an entry for selective access to the fluid-filled chambers.

13 Claims, 3 Drawing Sheets

MATTRESS OVERLAY FOR OPERATING ROOM TABLE

FIELD OF THE INVENTION

The present invention relates to therapeutic patient treatment systems. More particularly, the invention relates to an interface pressure relieving mattress overlay specifically adapted to address issues peculiar to the operating room theatre, including the need for stable positioning of a patient utilizing only highly radiolucent structures.

BACKGROUND OF THE INVENTION

The medical arts have long known the necessity of therapeutic patient treatment surfaces for the support of patients exhibiting one or more risk factors for skin deterioration. In fact, unless an individual patient has no indication of skin breakdown, it is now standard of care to place the patient on an interface pressure-minimizing surface. Because of prolonged pressure exerted over specific skin surfaces while under anesthesia, however, surgical patients in particular are at risk for ulcer formation even though otherwise exhibiting no predisposing factor. As a result, it is generally regarded as standard of care practice to, whenever possible, provide some pressure-reducing surface below all patients undergoing any one of all but the shortest of anesthesia-indicating procedures.

In practice, the surgical patient requiring interface pressure reduction has most often been supported upon a thin overlay of foam or gel-containing cushions placed atop the mechanical operating table. Because such overlays have been designed to support heavy patient loads and to be radiolucent, they are typically less than three inches in thickness. This thickness provides only marginally adequate interface pressure reduction, however, and as a result, some interest has developed in the use of thicker cushions. To this end, non-hollow plastic beads and silicon mixtures have been added to gels for use in surgical overlay cushions in an effort to increase radiolucence. Unfortunately, this practice has not succeeded in eliminating the dramatic increase in X-ray power levels that may be required when thicker cushions are employed. In an attempt to address the problem of excessive radiation levels during surgery, some attention has been directed toward the development of air surfaces for use in the operating room theatre. While such systems are known to produce very low interface pressures and are extremely radiolucent, they unfortunately present some severe disadvantages when utilized in the surgical setting. Of primary concern, air surfaces tend not to provide the necessary stability for the conduct of surgical procedures. With an air surface, it is difficult to position and hold the patient in any posture other than prone or supine. In many cases, support packs must be used to prop the patient. Unfortunately, however, the solution is not so simple; because air surfaces can be very smooth, such support packs may be subject to lateral displacement during the surgical procedure.

Additionally, air surfaces are susceptible to needle sticks and scalpel cuts. With sizeable scalpel cuts, resulting damage can deflate the support surface mid-procedure, which is extremely inconvenient for the surgical team.

Finally, most air surfaces are often powered and thus dictate the additional deployment of ancillary equipment. It is well known that such additional clutter is to be avoided in the operating room, if at all possible.

With the foregoing deficiencies of the prior art in mind, it is a primary object of the present invention to improve over the prior art by providing a mattress overlay for use with an operating room table that addresses issues of skin breakdown without compromising patient stability upon the surface or necessitating increased radiation exposure.

SUMMARY OF THE INVENTION

In accordance with the foregoing objects, the present invention—a pad or mattress overlay for use atop a conventional operating room table—generally comprises at least one pad, having a chamber for containing a quantity of fluid, for supporting a patient; a deformable and pressure compensating, radiolucent fluid contained within the chamber; and wherein the chamber and the fluid are cooperatively adapted to substantially minimize interface pressure and shear force between the pad and the patient supported thereon. In the preferred embodiment, the fluid comprises glass microspheres which increase its radiolucence.

In at least one embodiment, the chamber and the fluid are further cooperatively adapted to maintain the patient in fixed position upon said pad. To this end, the fluid is characterized as being flowable in response to substantially continuously applied pressure, but essentially non-flowable in the absence of such pressure and the chamber comprises a dual-layer, urethane envelope. The envelope has an upper portion and a lower portion and the chamber is removably affixed to a base member, preferably a foam board. Because in the preferred embodiment of the present invention the envelope is chemically adhered to the foam board, the lower portion is constructed from thicker urethane sheets than is the upper portion.

In at least one embodiment, a plurality of fluid-filled chambers are provided and any one of the fluid-filled chambers may be removed from the base member and replaced without damage to any other of the fluid-filled chambers. The mattress overlay also comprises a cover sheet having a urethane outer portion and a nylon inner portion. This cover sheet is preferably removably attachable about the fluid-filled chambers and comprises an entry for selective access to the fluid-filled chambers. This entry may comprise a zipper, preferably hidden beneath a flap in order to improve the contamination resistant characteristics of the mattress overlay.

In another embodiment, however, preferred for transplant and other surgeries involving large amounts of patient fluids, the cover sheet is seam-sealed about the fluid-filled bladders. In this embodiment, the cover sheet further comprises a check valve for allowing substantially uninhibited outward airflow but only very slow, filtered inward airflow. In this manner, the check valve is adapted to prevent inward flow of liquids.

Finally, many other features, objects and advantages of the present invention will be apparent to those of ordinary skill in the relevant arts, especially in light of the foregoing discussions and the following drawings, exemplary detailed description and appended claims.

BRIEF DESCRIPTION OF THE DRAWINGS

Although the scope of the present invention is much broader than any particular embodiment, a detailed description of the preferred embodiment follows together with illustrative figures, wherein like reference numerals refer to like components, and wherein.

DETAILED DESCRIPTION OF THE PREFERRED EMBODIMENT

Although those of ordinary skill in the art will readily recognize many alternative embodiments, especially in light of the illustrations provided herein, this detailed description is exemplary of the preferred embodiment of the present invention, the scope of which is limited only by the claims appended hereto.

Figure 1:
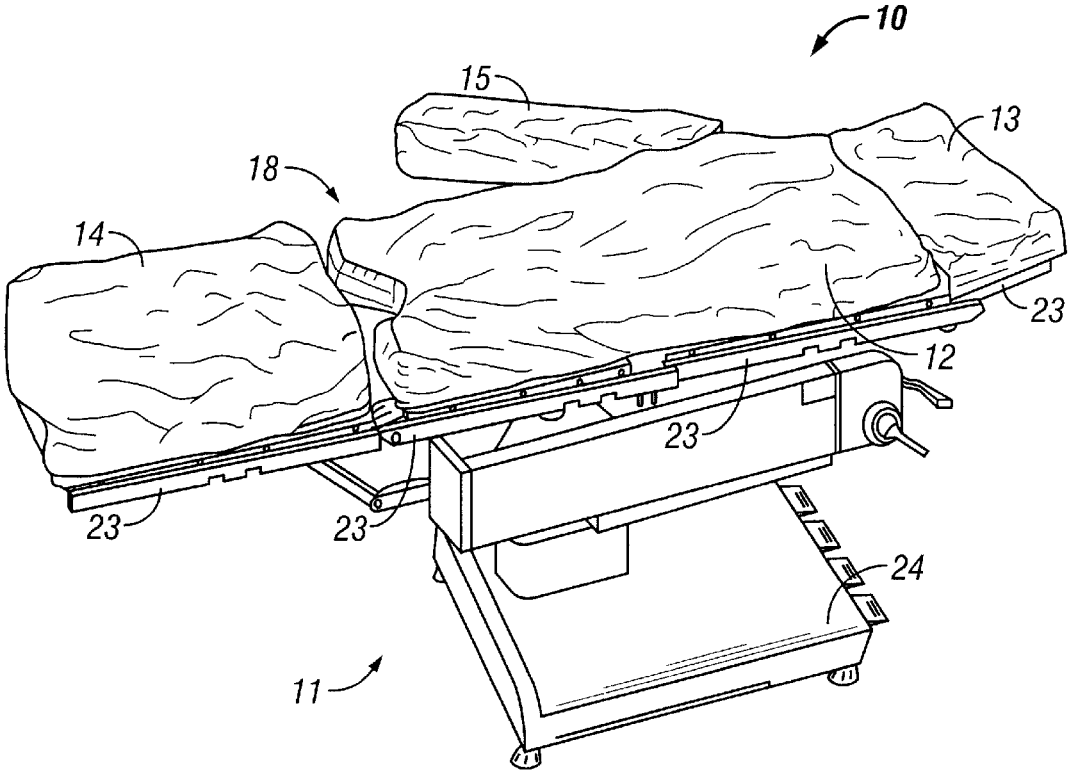
FIG. 1 is a perspective view of the mattress overlay of the preferred embodiment of the present invention as employed atop a conventional operating room table.

Referring now to FIG. 1, the preferred embodiment of the mattress overlay 10 of the present invention is shown to generally comprise a complete pad replacement system adapted for universal use with a variety of conventional operating room tables 11. As is well-known to those of ordinary skill in the art, such operating room tables 11 typically comprise a plurality of articulating sections supported atop a stable base 24. An exemplary table, similar to that shown in FIG. 1, is commercially available through the Steris Corporation of Mentor, Ohio under the trade designation "AMSCO 2080."

As will be better understood further herein, the mattress overlay 10 of the present invention is self-adjusting to support a wide weight range of patients with great stability and very little X-ray attenuation. The mattress overlay 10 of the preferred embodiment of the present invention comprises a torso pad 12, head pad 13, foot pad 14 and one or two arm board pads 15. It will be understood by those of ordinary skill in the art, however, that many of the objects of the present invention may be achieved through implementations comprising as few as one of the pads 12, 13, 14, 15.

Figure 2:
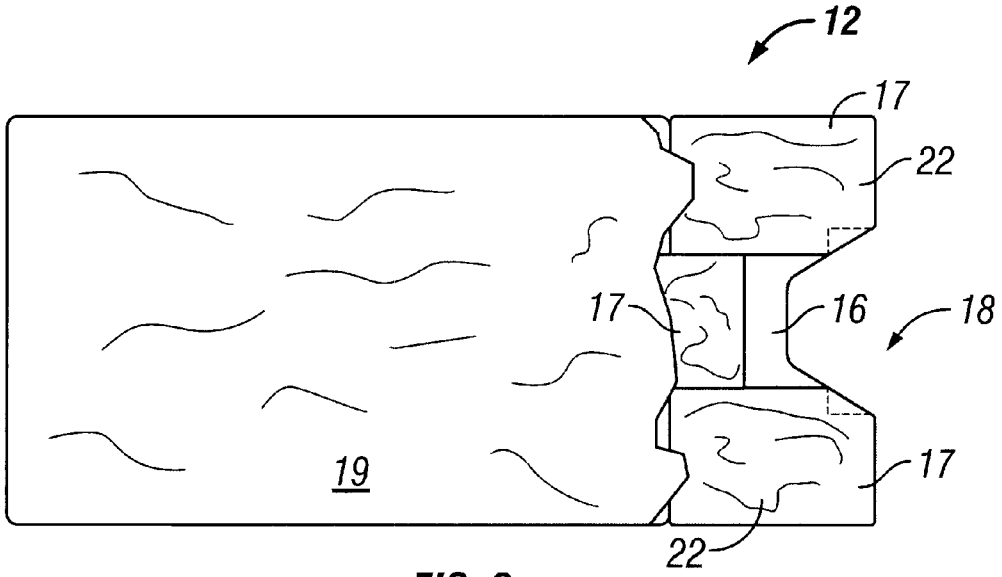
FIG. 2 is a partially cut away top plan view of the torso pad of the mattress overlay of FIG. 1 showing, in particular detail, the arrangement of some of the fluid bladders in the sacral region of the pad.
Figure 2A:
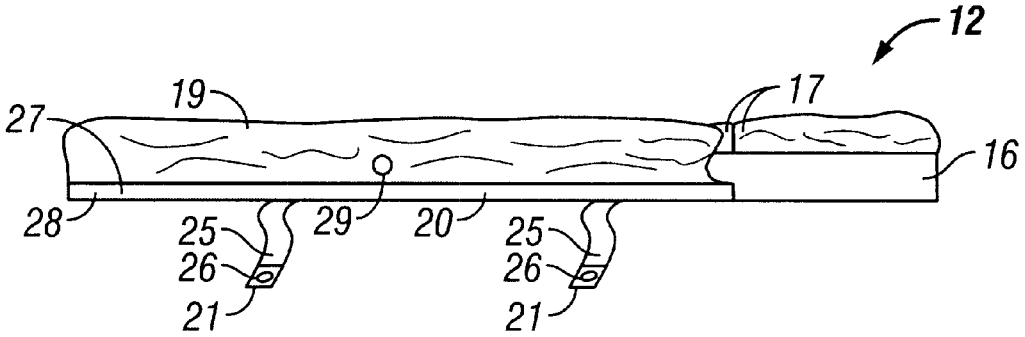
FIG. 2A is a partially cut away side plan view of the torso pad of FIG. 2 showing, in particular, the arrangement of the fluid bladders upon the foam base of the pad and the positioning of the attaching means by which the cover of the pad is affixed thereto.
Figure 3:
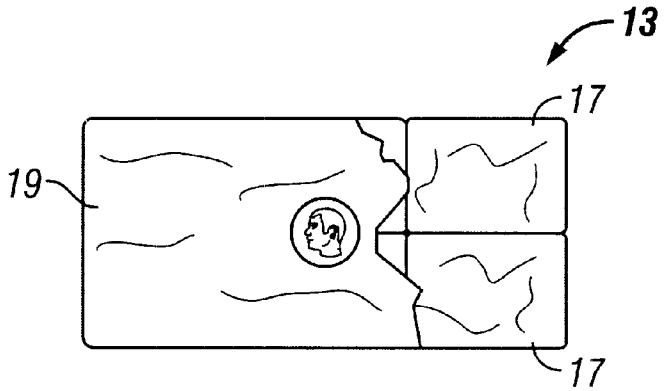
FIG. 3 is a partially cut away top plan view of the head pad of the mattress overlay of FIG. 1 showing, in particular, the arrangement of some of the fluid bladders contained therein.
Figure 4:
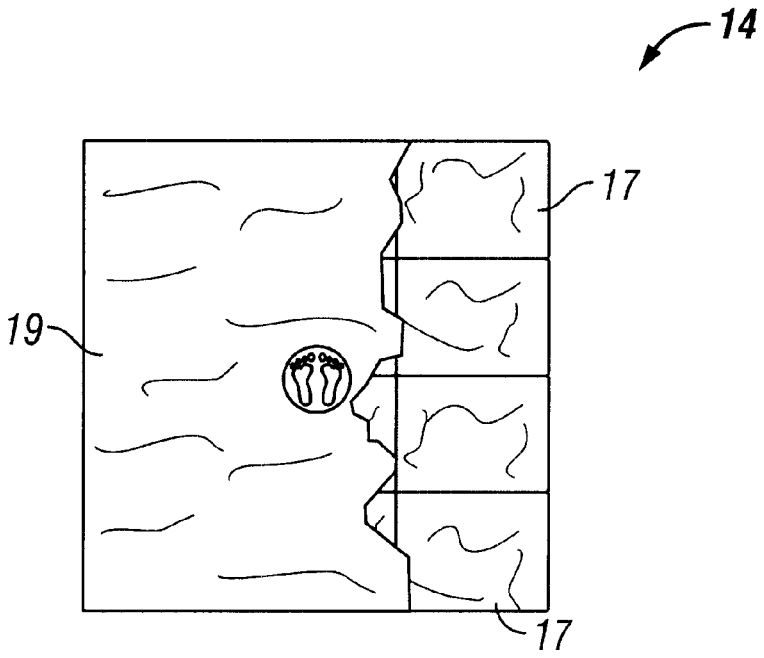
FIG. 4 is a partially cut away top view of the foot pad of the mattress overlay of FIG. 1 showing, in particular, the arrangement of some of the fluid bladders contained therein.

Referring now to FIGS. 2 and 2A, the torso pad 12 of the present invention is described in detail as exemplary of each of the pads 12, 13, 14, 15 of the mattress overlay 10. As shown in the figures, each pad 12, 13, 14, 15 generally comprises a plurality of fluid-filled bladders 17 arranged upon a foam base 16 and encased within a cover 19. As detailed further herein, each fluid bladder 17 comprises a dual-layer urethane chamber containing a necessary quantity of deformable and pressure compensating fluid. According to the present invention, this fluid is characterized as being flowable in response to substantially continuously applied pressure but essentially non-flowable in the absence of such pressure. In the preferred embodiment of the present invention, a fluid as is commercially available in Applicant's RIK Mattress system or as described in U.S. Pat. No. 4,728,551 issued Mar. 1, 1998 to Jay is utilized. By this reference, the full disclosure of U.S. Pat. No. 4,728,551, including the claims, is incorporated herein as though now set forth in its entirety. Although less preferred, other fillers may also be utilized instead of the preferred fluid while still falling within the scope of certain aspects of the present invention. One such alternative filler may be the filler material described in U.S. Pat. Nos. 5,421,874, 5,549,743, and 5,626,657.

Because the fluid utilized in the preferred embodiment of the present invention comprises glass microspheres the overlay 10 constructed therewith is highly radiolucent. As a result, Applicant has found that pads 12, 13, 14, 15 with thickness on the order of three inches or more may be implemented without requiring overly increased X-ray power levels during surgical use. In test, Applicant has been able to achieve 2 mm Al performance, within the established standard for surgical pads, with only 60 kV at 8 mA power. This X-ray performance is well within the requirements for orthopedic surgeries and necessitates only slight power boosting for microsurgical applications. Consequently, the overlay 10 constructed according to the teachings of the present invention is able to provide excellent interface pressure relief without exposing the patient to unnecessarily hazardous radiation levels.

It should be noted that although the maximum benefit of the present invention is obtained utilizing a fluid as hereinabove described, other substantial equivalents may be possible. It may also be possible to appreciate many aspects of the present invention utilizing other fill materials. For example, U.S. Pat. No. 5,592,706 issued to Pearce on Jan. 14, 1997 and U.S. Pat. No. 5,829,081 issued to Pearce on Nov. 3, 1998 each describe bladders filled with a fluid of a nature that may be utilized, with only corresponding sacrifice in performance, in the present invention. By this reference, therefore, the full disclosures of U.S. Pat. No. 5,592,706 and U.S. Pat. No. 5,892,081 are incorporated herein as though now set forth in their respective entireties.

As shown in FIGS. 2 through 5A, each of the fluid-filled bladders 17 is generally rectangular in form. As also shown, a plurality of the fluid-filled bladders 17 is arranged as necessary to form the general shape of each pad 12, 13, 14, 15 of the mattress overlay 10. According to the preferred embodiment of the present invention, fourteen bladders 17 are arranged within the torso pad 12; six bladders 17 are arranged within the head pad 13; twelve bladders 17 are arranged within the foot pad 14; and four bladders 17 are arranged within each arm board pad 15. As will be apparent to those of ordinary skill in the art, each bladder 17 may be sized as required to form each pad 12, 13, 14, 15 and greater or fewer bladders 17 may be utilized. Those of ordinary skill in the art will also recognize, however, especially in light of the disclosures made herein, that the number of bladders 17 utilized and the dimensions thereof will directly affect the performance to of the present invention.

As mentioned hereinabove, each fluid-filled bladder 17 comprises a dual-layer urethane covering. This dual-layer urethane covering has been found to give each fluid-filled bladder 17 a self-sealing characteristic wherein bladder failure due to needle sticks and the like is essentially eliminated. This is due, at least in part, to the utilization of a fluid as previously described. Because each fluid-filled bladder 17 is preferably adhered directly to the foam base 16 of one of the pads 12, 13, 14, 15, Applicant has found it desirable to construct each fluid-filled bladder 17 with four sheets of urethane, each cut to shape and then perimetrically sealed. In this manner, a lighter weight urethane may be utilized for the upper layers, which are in closest proximity to the patient, while a heavier weight urethane may be utilized for the lower layers, which must bear the adhesive. The fluid, as previously described, is contained between the second and third layers.

Each pad 12, 13, 14, 15 is contained within a cover 19 generally comprising a two-layer sheet having a urethane outer portion and a nylon inner portion. Although those of ordinary skill in the art will recognize that this configuration goes directly opposite the teachings of prior art designs, Applicant has found this configuration desirable in that it provides a highly stain-resistant surface even in the presence of heavy betadyne usage. The surface is also fluid impermeable, anti-static, anti-bacterial and, when properly encasing the pad, the cover 19 provides for wipe-down sterilization. As shown particularly in FIGS. 2A and 5A, the cover 19 is preferably removably attached to each pad 12, 13, 14, 15. In this manner, each bladder 17 may be easily accessed for repair or replacement as necessary or the entire cover 19 may be replaced if required. As shown, a zipper 28 or equivalent attachment means is preferably provided beneath a flap 27 toward the bottom of each pad 12, 13, 14, 15. Protection in this manner will aid in preventing contamination, even in the presence of heavy patient fluid flows.

Figure 5:
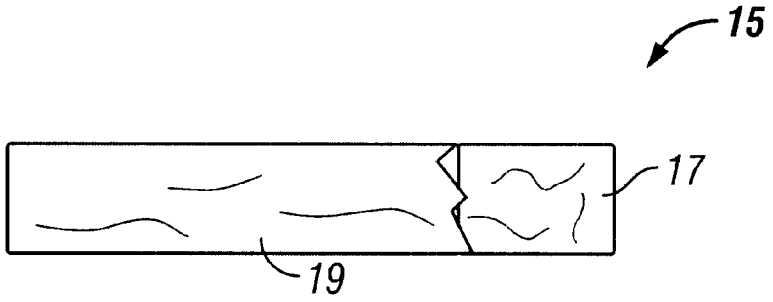
FIG. 5 is a partially cut away top view of arm board pad of the mattress overlay of FIG. 1 showing, in particular, the arrangement of some of the fluid bladders contained therein.
Figure 5A:
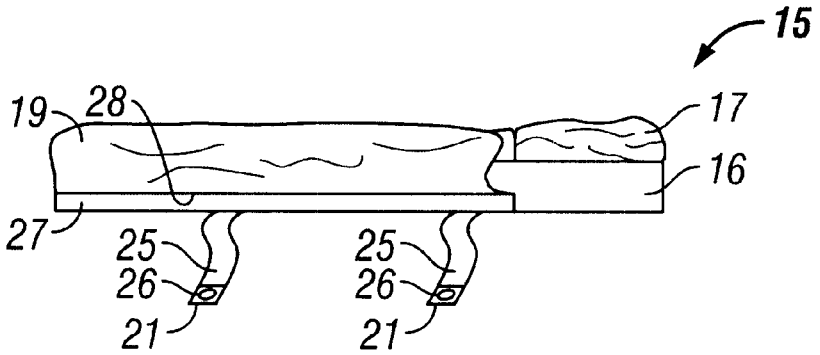
FIG. 5A is a partially cut away side view of the arm board pad of FIG. 5 showing, in particular, details of the attachment of the arm board pad to the operating table used therewith.

As also shown in FIGS. 2A and 5A, the various pad 12, 13, 14, 15 each comprise a means 21 for attachment of the pad 12, 13, 14, 15 to the operating room table 11. According to the preferred embodiment of the present invention, this attachment 12 comprises a plurality of nylon straps 25, each strap 25 further comprising a patch 26 of hook or loop type material such as that commercially available under the well-known trademark "VELCRO." In preparation for use, each pad 12, 13, 14, 15 is placed upon the appropriate articulating section 23 of the operating room table 11 and then secured in place with its respective strap 25.

As shown in the various figures, the covers 19 fit loosely over each pad 12, 13, 14, 15 to generally present a wrinkled interface with the patient surface. Likewise, each fluid-filled bladder 17 is only partially filled, thereby resulting in a similarly wrinkled upper surface. Those of ordinary skill in the art, however, will recognize that wrinkles beneath the patient have to date been generally regarded as hazardous, having been shown to contribute to skin breakdown. In fact, with prior art designs, a great deal of attention from the surgical team has been required for the continuous removal of wrinkles from the patient-supporting surface. Although wrinkle control has been a perplexing issue in the prior art, necessary to prevent occlusion of capillary blood flow, this is not the case with the present invention. In the present invention, the bladders 17 as filled with a fluid of the characteristics hereinabove described are so conformable to the patient that wrinkles do not impede capillary blood flow. As a result, wrinkles in the patient-supporting surfaces may be advantageously used to eliminate shearing forces, thereby preventing skin breakdown. This ability to reduce shearing forces is a major advantage of the present invention as compared to previously known operating room table pad systems.

In test, the present invention has resulted in greatly reduced incidence of skin breakdown, even for patients undergoing very prolonged operations, and less patient discomfort in the post-operative recovery period. In one series of uses for head and neck cancer surgery, involving the grafting of skin from the legs to the head and neck area for reconstruction, the skin breakdown incidence was reduced from an average of 40%, with prior art pads, to zero. In this series of tests, the mean surgery length was 17 hours, with a maximum length of 32 hours. The mattress overlay 10 of the present invention is able to achieve such results due to the fact that the patient can be nearly completely immersed in the fluid with almost total conformation of the patient-interfacing surface to the patient's body, including the most bony prominentia. Because the fluid as hereinabove described is very viscous, the patient supported upon the overlay 10 of the present invention remains very stable even when torqued by the surgeon into a very unnatural position. The great stability offered by the present invention and the pressure reducing capabilities thereof, especially when coupled with the high radiolucence exhibited, make clear that the teachings of the present invention represent an important and significant development in the art.

In use, the various pads 12, 13, 14, 15 of the mattress overlay 10 are generally placed upon the articulating sections 23 of the operating room table 11 and secured in place. The patient is then placed atop the mattress overlay 10 and positioned by the surgeon as desired for the surgical procedure. As has been discussed, patient placement is greatly enhanced by the stable nature of the pads 12, 13, 14, 15 as implemented according to the teachings of the present invention. In an extension of these teachings, Applicant has found that due to the highly conformable nature of the fluid-filled bladders 17, the foam base 16 of the head pad 13 may be removed whereafter upon removal of the articulating section 23 of the head region the patient's head may be placed upon the surgeon's lap with only the modified head cushion 13 interposed therebetween. In this alternative embodiment, the fluid-filled bladders 17 conform to both the patient's head and the surgeon's lap enabling the surgeon to position the head through leg movement while keeping both hands free for the easier performance of the surgical procedure. This type of lap surgery has been successfully performed in the pediatric oral surgery arena and has resulted in control and stability not attainable through the use of gel packs or other cushions.

While the foregoing description is exemplary of the preferred embodiment of the present invention, those of ordinary skill in the relevant arts will recognize the many variations, alterations, modifications, substitutions and the like as are readily possible, especially in light of this description, the accompanying drawings and claims drawn thereto. For example, the zipper 28 of the cover attachment 20 may be replaced in an embodiment comprising a seam-sealed cover 19. This type of cover 19 is advantageous for use in surgeries involving extreme amounts of fluids such as, for example, organ transplants, which require a great deal of organ cleaning. In implementing such an embodiment, a one-way check valve 29 is preferably inserted into the cover 19 for the uninhibited outward escape of air and allowing only for a very slow intake of filtered air. Such a valve 29 serves to retain the immersion qualities of the system while simultaneously enabling greater immunity from surgical fluid contamination. In any case, because the scope of the present invention is much broader than any particular embodiment, the foregoing detailed description should not be construed as a limitation of the scope of the present invention, which is limited only by the claims appended hereto.

What is claimed is:

1. A patient supporting surface for use with an operating room table, the patient supporting surface comprising:

at least one pad for supporting a patient, the pad comprising a chamber for containing a quantity of fluid;

the chamber comprising a dual-layer, urethane envelope having an upper portion and a lower portion; and a deformable and pressure compensating fluid contained within the chamber, the fluid being substantially radiolucent;

wherein the chamber and the fluid are cooperatively adapted to maintain the patient in fixed position upon the pad while substantially minimizing interface pressure and shear force between the pad and the patient supported thereon.

2. The patient supporting surface as recited in claim 1, said patient supporting surface further comprising:

a base member; and wherein said chamber is removably affixed to said base member.

3. The patient supporting surface as recited in claim 2, wherein said base member comprises a foam board.

4. The patient supporting surface as recited in claim 3, wherein said lower portion of said chamber is affixed, yet still removably so, to the foam board with a chemical adhesive.

5. The patient supporting surface as recited in claim 4, wherein said lower portion of said chamber comprises thicker urethane than comprises said upper portion of said chamber.

6. The patient supporting surface as recited in claim 2, said patient supporting surface further comprising:

a plurality of fluid-filled chambers; and wherein any one of said fluid-filled chambers may be removed from said base member and replaced without damage to any other of said fluid-filled chambers.

7. The patient supporting surface as recited in claim 6, said patient supporting surface further comprising a cover sheet.

8. The patient supporting surface as recited in claim 7, wherein said cover sheet is removably attachable about said fluid-filled chambers.

9. The patient supporting surface as recited in claim 7, wherein said cover sheet comprises an entry for selective access to said fluid-filled chambers.

10. The patient supporting surface as recited in claim 9, wherein said entry comprises a zipper.

11. The patient supporting surface as recited in claim 10, wherein:

said entry further comprises a flap; and said zipper is concealable beneath said flap.

12. The patient supporting surface as recited in claim 1, wherein the pad further comprises:

a plurality of fluid-filled chambers; and a cover sheet that surrounds the fluid-filled chambers;

said cover sheet being seam-sealed about said fluid-filled chambers.

13. A patient supporting surface for use with an operating room table, the patient supporting surface comprising:

at least one pad for supporting a patient, the pad comprising a plurality of fluid-filled chambers and a base member that supports the fluid-filled chambers;

a deformable and pressure compensating fluid contained within each chamber, the fluid being substantially radiolucent; and a cover sheet surrounding the pad and the fluid-filled chambers, the cover sheet having a urethane outer portion and a nylon inner portion.

* * * * *